United States Patent [19]

Jaques

[11] 4,363,433

[45] Dec. 14, 1982

[54] PAINTER'S HOLSTER

[76] Inventor: Dean Jaques, P.O. Box 19, Burns, Oreg. 97720

[21] Appl. No.: 892,374

[22] Filed: Mar. 31, 1978

[51] Int. Cl.[3] ..... B44D 3/00

[52] U.S. Cl. ..... 224/253; 206/362; 220/20

[58] Field of Search ..... 224/5 R, 5 A, 5 B, 5 T, 224/26 R, 26 B, 5 W, 253; 220/17, 23.4, 90, 20; 206/362.4, 229, 1.7, 362

[56] References Cited

U.S. PATENT DOCUMENTS

| | | | |
|---|---|---|---|
| Re. 11,302 | 1/1893 | Deming et al. | 220/90 X |
| 515,899 | 3/1895 | Breithaupt | 224/26 R X |
| 1,238,830 | 9/1917 | Schuster et al. | 224/5 R X |
| 2,057,828 | 10/1936 | Hartwell | 206/362.4 |
| 2,140,688 | 12/1938 | Cohn | 224/5 MAX |
| 3,283,971 | 11/1966 | Jone | 224/5 B |
| 3,997,092 | 12/1976 | Pogwized | 224/26 R |

FOREIGN PATENT DOCUMENTS

| | | | |
|---|---|---|---|
| 722496 | 11/1965 | Canada . | |
| 64747 | 3/1913 | Switzerland | 224/5 A |
| 650268 | 2/1951 | United Kingdom | 224/5 MA |

*Primary Examiner*—Joseph J. Rolla
*Attorney, Agent, or Firm*—Paul F. Horton

[57] ABSTRACT

A painter's holster including loops for attaching the holster to a belt, a substantially rectangular paint reservoir having a top opening downwardly beveled from back to front for covenient brush access to the reservoir, a V-shaped paint brush container secured to an external side of the reservoir to hold a paint brush securely and to prevent drying of the paint on the brush. The holster may also contain a second paint brush container on an opposite side, identical to the first brush container, and may further include a sponge brush applicator container on the front external wall of the reservoir.

4 Claims, 4 Drawing Figures

PAINTER'S HOLSTER

BACKGROUND OF THE INVENTION

1. Field of the Invention

This invention relates, in general, to painter's aids, and in particular to painter's holsters.

2. Description of the Prior Art

The desirability of having a paint container and brush holder attached to the person has long been recognized. Such devices generally take the form of a belt having a fixed paint carrier and brush holder attached to the front of the belt, as typified by U.S. Pat. No. 1,109,161, issued to G. Chindgren, or as aprons, as typified by U.S. Pat. No. 2,717,109, issued to B. A. Walsh. More recent advances in the art, include the painter's aprons of Jones, U.S. Pat. No. 3,283,971 and Johannes, U.S. Pat. No. 3,535,709.

Such devices are convenient, in that brushes and paint are always within convenient reach of the painter. The devices are essential for safety while working on ladders, scaffolds, roofs, and the like, in that they free both hands for climbing and at least one hand for grasping a structure while painting. While being distinctly advantageous over prior art, such devices are inconvenient and present problems in several respects. The paint reservoirs, invariably, have a horizontal top opening, which requires the painter to bring the hand holding the paint brush to an unnatural height to clear the sides of the reservoir to dip the brush, rather than following the natural arc of the arm. Additionally, such devices utilize pins, magnets, clips, and open reservoirs for supporting the brushes. Such holders allow paint adhering to the brush to dry quickly; do not secure the brush sufficiently, allowing accidental dropping of the brush; do not provide convenient access to the handle of the brush, the holder often being attached to the handle; and allow dripping. Furthermore, aprons and fixed belts restrict positioning of the apparatus on the person to but one position. Present devices also do not provide means for securely holding the recently developed, and increasing popular sponge brush applicator.

SUMMARY OF THE INVENTION

An accurate description of the invention may be found in the appended claims. Generally, the painter's holster of the present invention includes a substantially rectangular reservoir having a top opening downwardly declining from back to front; loop members for convenient attachment to a belt and a V-shaped enclosure having a top opening for holding conventional paint brushes. The holster may further include a second brush holder, identical with the first, and means on the front of the reservoir for holding a sponge brush applicator.

It is therefore an object of the present invention to provide a painter's holster having a paint reservoir with an top opening downwardly declining from back to front for convenient and natural dipping of the brush into the reservoir.

It is also an object of the present invention to provide a painter's holster having a substantially V-shaped brush container conforming substantially to the shape of the brush for holding a paint brush securely.

More particularly, it is an object of the present invention to provide a painter's holster having a substantially V-shaped brush container which holds a brush with its handle upstanding for unobstructed grasping of the handle.

It is a further object of the present invention to provide a painter's holster having a brush holder adapted to prevent rapid drying of paint adhering to a brush.

A still further object of the present invention is to provide a painter's holster having loop members for slidably engaging the user's belt for positioning the holster at a desired position on the user's person.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
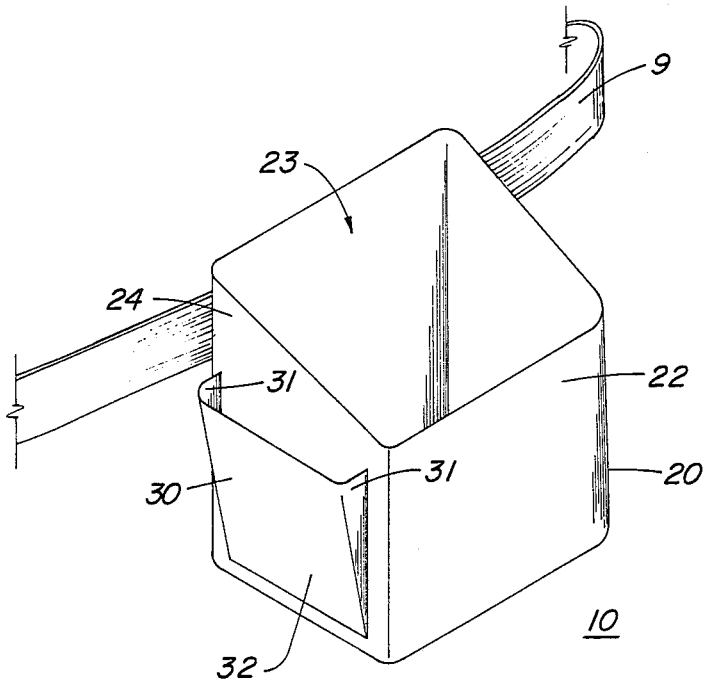
FIG. 1 is a perspective view of one embodiment of the present invention.
Figure 2:
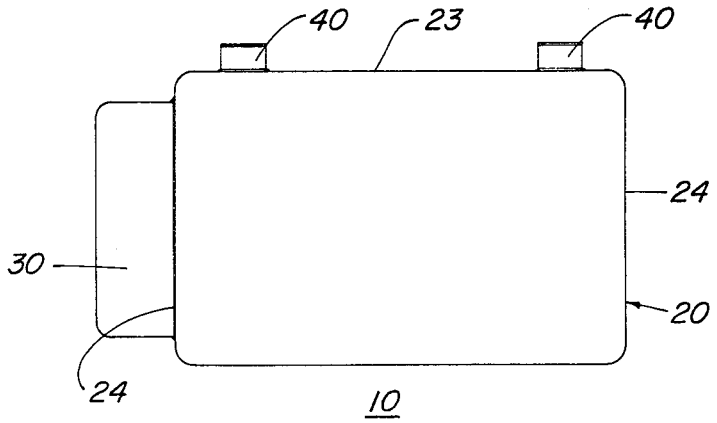
FIG. 2 is a plan view of the device of FIG. 1.
Figure 3:
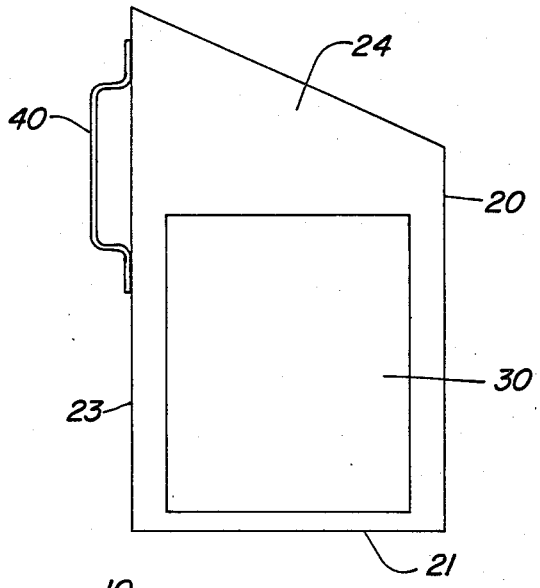
FIG. 3 is a side elevation of the device of FIG. 1.

Referring now to the drawings, and, in particular FIGS. 1 through 3, an embodiment to be preferred of a painter's holster 10 made according to the present invention, is disclosed. Painter's holster 10 includes a paint reservoir 20, paint brush holder 30, and loop members 40.

Paint reservoir 20 is substantially rectangular in horizontal section and includes a planar bottom wall 21, front wall 22, a back wall 23, and a pair of side walls 24, each sealingly connected to one another to make a fluid-tight container. As will be observed, side walls 24 are beveled to define a top opening which is downwardly declining from back wall 23 to front wall 22. Preferred width of the reservoir is 6½ inches and preferred depth is 4½ inches. Front wall 22 is 5 inches in height and back wall 23 has an overall height of 8 inches. Reservoir 20 is made of a material which is impervious to paint and may be made of any suitable material, as for example aluminum or polyvinyl.

Horizontally spaced on the exterior rear-most planar surface of back wall 23 are loop members 40, shown to advantage in FIGS. 2 and 3. Loop members 40 are preferably located adjacent the top of the back wall and may be of any size suitable to accomodate a standard belt 9. Loops 40 may be made of any suitable material and is preferably integral with reservoir 20 where plastic is used.

Figure 4:
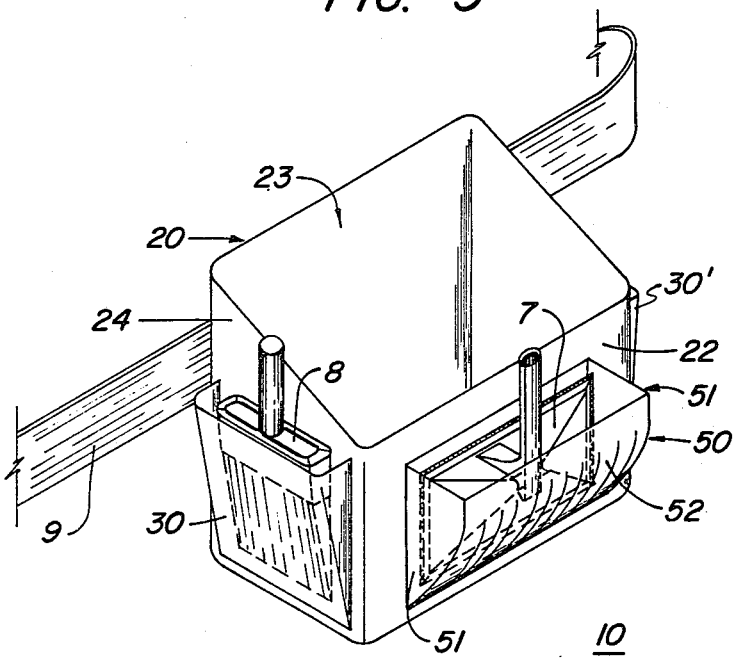
FIG. 4 is a perspective view of a modification of the device of FIG. 1, showing a second brush holder and a sponge brush applicator holder.

Sealingly engaging one of the side walls 24 is paint brush container 30 for securedly holding a standard paint brush 8 in a substantially vertical position, as may be seen in FIG. 4. Referring again to FIGS. 1 through 3, the construction of paint brush container may be seen. Container 30 includes a pair of planar, triangular side portions 31 having one edge sealingly engaging side wall 24 and a rectangular end portion 32 sealingly connected to the opposing edges of side portions 31 and to side wall 24 adjacent its lower-most terminal edge to define a V-shaped enclosure having a top opening for receiving the paint brush. It is contemplated that a second paint brush holder 30', identical in construction to brush container 30, may be sealingly attached to the other side wall 24. Paint brush container 30' may hold a single brush or a plurality of smaller brushes, as with container 30. Brush containers 30 and 30' are preferably made of the same material as reservoir 20 and may be integral therewith.

A third brush container 50, adapted to hold the recently developed sponge brush applicator, may be included on the planar exterior surface of front wall 22. Sponge brush holder 50 includes a pair of planar, substantially quarter-circular side walls 51 having one of the rectilinear edges sealingly engaging front wall 22 and a substantially rectangular front wall 52, curved to sealingly engage the opposing curved edges of side walls 51 to define a substantially quarter-round enclosure having a top opening. Sponge brush holder 50 is preferably made of the same material as reservoir 20.

In use, painter's holster 10 is attached to the user by threading belt 9 through loops 40. In this manner, it will be noted, that loops 40 slidably engage belt 9 to provide the user with an unlimited selection of rotational positions for placement of the holster about his waist. Once attached to the person, reservoir 20 may be filled with paint to a selected level and conventional paint brushes 8 inserted into containers 30 and 30'. In addition, a sponge brush paint applicator may be inserted into container 50. It will also be noted that all brushes so inserted will have their handles upwardly extending where they may be conveniently grasped without obstruction. Thus, with the paint in reservoir 20 and the brushes in the appropriate containers, the user has complete freedom in the use of his hands for climbing ladders, scaffolding, and the like. During the climbing process, holster 10 may be shifted to a side position on the hip to prevent accidental contact with the ladder rungs or other obstacles. Once the user is in position to paint, holster 10 may again be positioned as desired by the wearer. In dipping the brushes into the paint in reservoir 20, the arm may be retracted in a natural upward and inward arcuate manner because of the beveled top opening of the reservoir. This is in contrast to the awkward movement of raising the arm upwardly and then transversely to clear a horizontal side wall. The higher back wall 23 with the attached loop members 40 also provide increased stability for the reservoir. Once the user wishes to discontinue his painting, the brushes may be returned to their containers. In the containers, the brushes will be protected by the walls from substantial air movement and consequential rapid drying of the paint adhering to the brush. The downward V-shape of containers 30 and 30' conform to the conventional shape of such brushes and therefore hold the brushes tightly to prevent accidental dropping of the brushes. The containers also eliminate any dripping of the paint from the brush and simply collect any paint which may drain from the brushes.

Sponge brush applicator 7 is inserted into container 50 with the flat portion of the brush held firmly against the exterior surface of front wall 22 and with the handle portion engaging the interior of wall 52. In this manner, the paint contained within the sponge and the bristles is prevented from drying by its contact with wall 22 and the brush is prevented from dropping by the contact of the rear of the handle against the interior of wall 52. It is to be understood that a series of planar segments could readily be substituted for the curved surface of wall 52 to provide a container having the same function.

Having thus described in detail, several embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. An improved painter's holster comprising:

a rigid, substantially rectangular paint reservoir having a substantially planar bottom wall, side walls and front and rear walls, each sealingly connected to one another, and having a top opening downwardly declining from said rear wall to said front wall;

at least two loop members attached to the exterior rearward-most planar surface of said rear wall, horizontally spaced from one another adjacent the top of said rear wall and operable to slidingly engage a belt; and a brush holding means sealingly engaging the exterior planar surface of one of said side walls, said brush holding means including a pair of planar, triangular side portions and a rectangular end portion sealingly connected thereto to define a substantially V-shaped enclosure having a top opening below the level of the top opening of said paint reservoir for receiving a conventional paint brush.

2. A holster as described in claim 1, further comprising a second brush holding means identical in structure to said first brush holding means, sealingly engaging the exterior planar surface of the other side of said reservoir for holding a second paint brush.

3. A holster as described in claim 1, further comprising sponge brush holding means sealingly engaging the exterior planar surface of the front wall of said reservoir, said sponge brush holding means including a pair of planar, substantially quarter-circular side walls and a rectangular front wall curved to sealingly engage said side walls to define a substantially quarter-round enclosure having a top opening adapted to securely receive a sponge brush.

4. An improved painter's holster comprising:

a rigid, substantially rectangular paint reservoir having a substantially planar bottom wall, side walls and front and rear wall, each sealingly connected to one another, and having a top opening downwardly declining from said rear wall to said front wall;

at least two loop members attached to the exterior rearward-most planar surface of said rear wall, horizontally spaced from one another adjacent the top of said rear wall and operable to slidingly engage a belt;

a pair of brush holding means, each sealingly engaging the exterior planar surface of one of said side walls, each of said brush holding means including a pair of planar, triangular side portions and a rectangular end portion sealingly connected thereto to define a V-shaped enclosure having a top opening for receiving a conventional paint brush; and a sponge brush holding means sealingly engaging the exterior planar surface of the front wall of said reservoir, said sponge brush holding means including a pair of planar, substantially quarter-circular side walls and a rectangular front wall curved to sealingly engage said side walls to define a substantially quarter-round enclosure having a top opening for receiving a sponge brush.

* * * * *